US005553785A

United States Patent [19]

Haruch

[11] Patent Number: 5,553,785

[45] Date of Patent: Sep. 10, 1996

[54] ENHANCED EFFICIENCY APPARATUS FOR ATOMIZING AND SPRAYING LIQUID

[75] Inventor: James Haruch, Naperville, Ill.

[73] Assignee: Spraying Systems Co., Wheaton, Ill.

[21] Appl. No.: 371,086

[22] Filed: Jan. 10, 1995

[51] Int. Cl.[6] ..... B05B 1/30

[52] U.S. Cl. ..... 239/432; 239/434; 239/553.3

[58] Field of Search ..... 239/432, 427, 239/417.3, 416, 423, 424, 434, 553.3

[56] References Cited

U.S. PATENT DOCUMENTS

| | | | |
|---|---|---|---|
| 1,186,193 | 6/1916 | Hoffman | 239/432 |
| 1,427,910 | 9/1922 | Quinn | 239/427 |
| 1,535,702 | 4/1925 | Walsh et al. | 239/432 X |
| 1,757,023 | 5/1930 | Smith | 239/432 X |
| 3,929,290 | 12/1975 | Tallarovic | 239/432 X |
| 4,101,073 | 7/1978 | Curran | 239/432 X |
| 5,065,945 | 11/1991 | Vidusek et al. . | |
| 5,176,325 | 1/1993 | Vidusek . | |

*Primary Examiner*—Kevin Weldon
*Attorney, Agent, or Firm*—Leydig, Voit & Mayer, Ltd.

[57] ABSTRACT

A pressurized stream of liquid flowing into a body is divided into a plurality of angularly spaced jets which are rebounded in an upstream direction prior to being guided in a generally radially outward direction by a deflector surface. During flow along the deflector surface, the liquid is formed into a thin and very turbulent sheet which impinges against the edge portion of a plate and is shattered into small droplets. An annular curtain of pressurized air cross shears the droplets and breaks the droplets into finely atomized particles which are discharged through a spray nozzle.

9 Claims, 2 Drawing Sheets

ENHANCED EFFICIENCY APPARATUS FOR ATOMIZING AND SPRAYING LIQUID

BACKGROUND OF THE INVENTION

This invention relates generally to apparatus for atomizing and spraying liquid such as, for example, water, fuel, or chemicals. More specifically, the invention relates to apparatus of the type in which the liquid first is atomized mechanically and then is broken up into finer particles by virtue of being subjected to a pressurized stream of gas (e.g., air). Thereafter, the atomized liquid is sprayed into the atmosphere through a discharge nozzle.

A goal in atomizing and spraying apparatus is to achieve high efficiency. High efficiency in the context of the present apparatus refers to using as little air energy as possible to break liquid of a given volume into particles having a large total surface area. Larger surface areas are, of course, created by breaking the liquid into very fine particles.

SUMMARY OF THE INVENTION

The general aim of the present invention to provide air-assisted atomizing apparatus capable of operating at very high efficiency.

A more detailed object of the invention is to achieve the foregoing by providing atomizing apparatus in which mechanical breakup of the liquid internally of the apparatus is substantially increased so as to reduce the air energy required to effect the final atomization.

Still another object of the invention is to apply the pressurized air to the mechanically atomized liquid in a location and manner tending to maximize final atomization of the liquid.

These and other objects and advantages of the invention will become more apparent from the following detailed description when taken in conjunction with the accompanying drawings.

Figure 1:
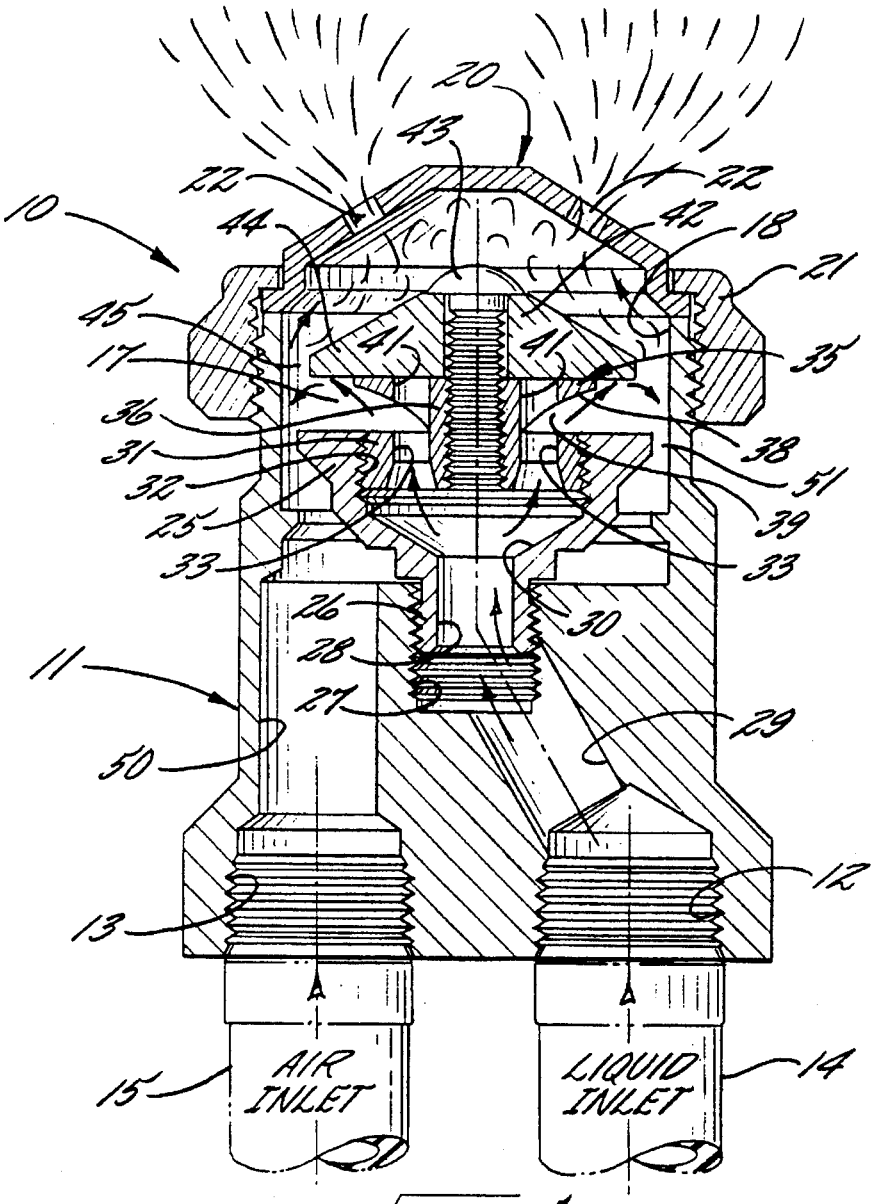
FIG. 1 is a cross-sectional view taken axially through one embodiment of new and improved atomizing and spraying apparatus incorporating the unique features of the present invention.

While the invention is susceptible of various modifications and alternative constructions, certain illustrated embodiments hereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE PREFERRED EMBODIMENTS

As shown in the drawings for purposes of illustration, the invention is embodied in apparatus 10 for atomizing liquid and for discharging the liquid into atmosphere as a very fine spray. The apparatus may, for example, be used to atomize and spray water in various environments.

The apparatus 10 includes a main body 11 made of metal or plastic and having one end formed with threaded inlet ports 12 and 13. Lines 14 and 15 are connected to the ports 12 and 13, respectively, and supply the body with pressurized streams of liquid and gas. The gas stream typically is pressurized air.

Figure 2:
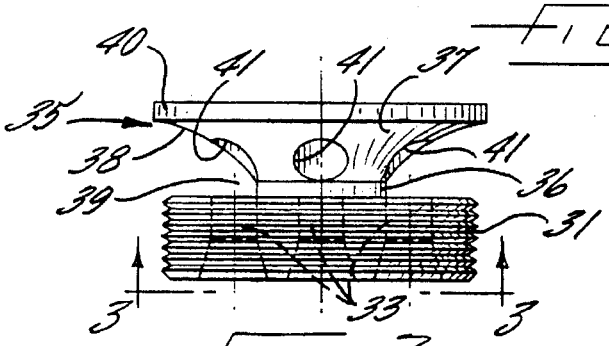
FIG. 2 is an enlarged elevational view of one of the components of the apparatus shown in FIG. 1.
Figure 3:
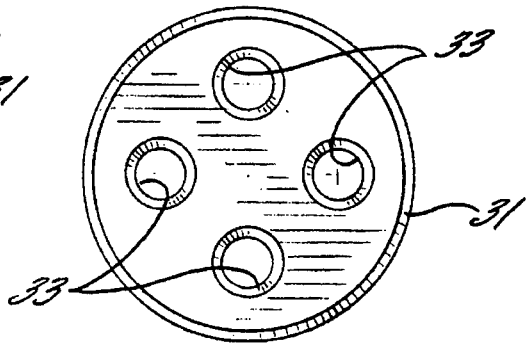
FIG. 3 is a plan view of the component illustrated in FIG. 2 as seen along the line 3—3 of FIG. 4 is a view similar to FIG. 1 but shows modified apparatus according to the invention.

Formed within and opening out of the opposite end of the body 11 is a chamber 17 which is defined in part by a generally cylindrical side wall 18. Liquid and air are introduced into the chamber from the ports 14 and 15, the liquid is atomized and then is propelled out of the chamber in the form of a fine spray for discharge through a nozzle 20. The latter is located in abutting engagement with the end of the body 11 and is clamped thereto by a cap 21 which is threaded onto the body. In the embodiment of FIGS. 1–3, the nozzle is formed with angularly spaced discharge ports 22 which herein are angled so as to create a diverging spray pattern.

In accordance with the present invention, means are provided in the chamber 17 for mechanically disintegrating the liquid stream into extremely fine particles so that only relatively low air energy is required to effect final atomization of the liquid. In this way, the efficiency of the apparatus is increased in that air at a comparatively low volumetric flow rate is effective to atomize a given volume of liquid into fine particles having high surface area.

Herein, the aforementioned means include a mounting insert 25 located in the chamber 17 and formed with an externally threaded neck 26 which is screwed into a tapped bore 27 in the body 11. The insert is formed with an axially extending passage 28 which communicates with the liquid inlet port 12 via an angled passage 29 in the body. Downstream of the passage 28, the insert is formed with a generally frustoconical expansion chamber 30 which flares outwardly upon progressing downstream.

In carrying out the invention, the downstream end of the expansion chamber 30 is closed by a member 31 which divides the liquid stream flowing through the passage 28 into a plurality of angularly spaced jets. In this particular instance, the member 31 is in the form of an externally threaded plug which is screwed into a tapped bore 32 formed in the mounting insert 25 just downstream of the expansion chamber 30. Four circumferentially spaced holes or orifices 33 are formed through the plug 31 and establish communication between the expansion chamber 30 and the main chamber 17. The orifices are equally spaced and, in lieu of four orifices, the plug could be formed with two or three orifices or with more than four orifices. Each orifice includes a generally cylindrical downstream portion and further includes a generally frustoconical upstream portion which tapers upon progressing downstream.

The plug 31 forms an integral part of a larger component 35 (FIG. 2) which includes a center post 36 extending downstream from the plug and located inwardly of the orifices 33. Also forming an integral part of the component 35 is a deflector 37 which is spaced downstream from the downstream end of the plug. The deflector includes a concavely curved surface 38 which faces the plug and which progresses radially outwardly upon proceeding axially away from the plug. By virtue thereof, an annular slot 39 is defined between the plug 31 and the deflector surface 38, the slot becoming progressively wider in the axial direction as the slot proceeds radially outwardly. The extreme outer periphery of the curved deflecting surface 38 merges into a cylindrical portion 40 (FIG. 2) which defines the extreme downstream end of the component 35.

Axially extending and generally cylindrical holes 41 are formed through the deflector 37 and are aligned with the orifices 33 in the plug 31. A plate 42 is secured to the downstream end of the component 35 and closes off the downstream ends of the holes 41. The plate 42 is clamped to the component 35 by a screw 43 extending through a hole in the plate and threaded into a hole in the post 36.

As shown in FIG. 1, the plate 42 includes a peripheral edge portion 44 which extends radially outwardly beyond the outer periphery of the cylindrical portion 40 of the component 35. The plate is circular in cross-section and its outer peripheral edge is spaced radially inwardly from the wall 18 of the chamber 17 so that an annular gap 45 is defined between the plate and the wall. The downstream end of the plate is generally frustoconical and tapers in a downstream direction.

With the foregoing arrangement, a pressurized stream of liquid supplied through the line 14 flows into the expansion chamber 30 via the port 12, the passage 29 and the passage 28. Upon encountering the upstream end of the plug 31, the single stream is broken into four angularly spaced streams or jets which are discharged through the orifices 33. Most of the liquid in the jets shoots into the holes 41, strikes the plate 42 and bounces back toward the downstream end of the plug. Such liquid is propelled outwardly along the deflector surface 38 by the jets being discharged through the orifices 33 and as an incident thereto, is spread into a thin and very turbulent sheet. Upon leaving the deflector surface and emerging from the slot 39, the thin sheet of liquid impinges against the peripheral edge portion 44 of the plate 42 and is shattered into fine droplets which flow through the gap 45 between the plate and the chamber wall 18.

Further in keeping with the invention, the pressurized stream of air from the supply line 15 is formed into an annular curtain which cross shears the droplets proceeding toward the gap 45 in order to further atomize the droplets. For this purpose, the port 13 communicates with the chamber 17 by means of a passage 50 formed in the body 11 and opening into the chamber adjacent the wall 18 thereof. As the air flows downstream, it passes through a relatively narrow gap 51 between the wall 18 and the outer periphery of the mounting insert 25 and is formed into a high velocity annular curtain. Upon proceeding downstream toward the gap 45, the curtain impacts against and shears through the liquid particles shattered by the peripheral edge portion 44 of the plate 42. Because those particles are in the form of a thin sheet at the time they are impacted by the air, less energy is required to break the particles into still finer particles having a high surface area. Accordingly, the apparatus 10 operates with comparatively high efficiency in that a given volume of liquid may be broken into fine particles having a large surface area with a relatively low volume of air.

Figure 4:
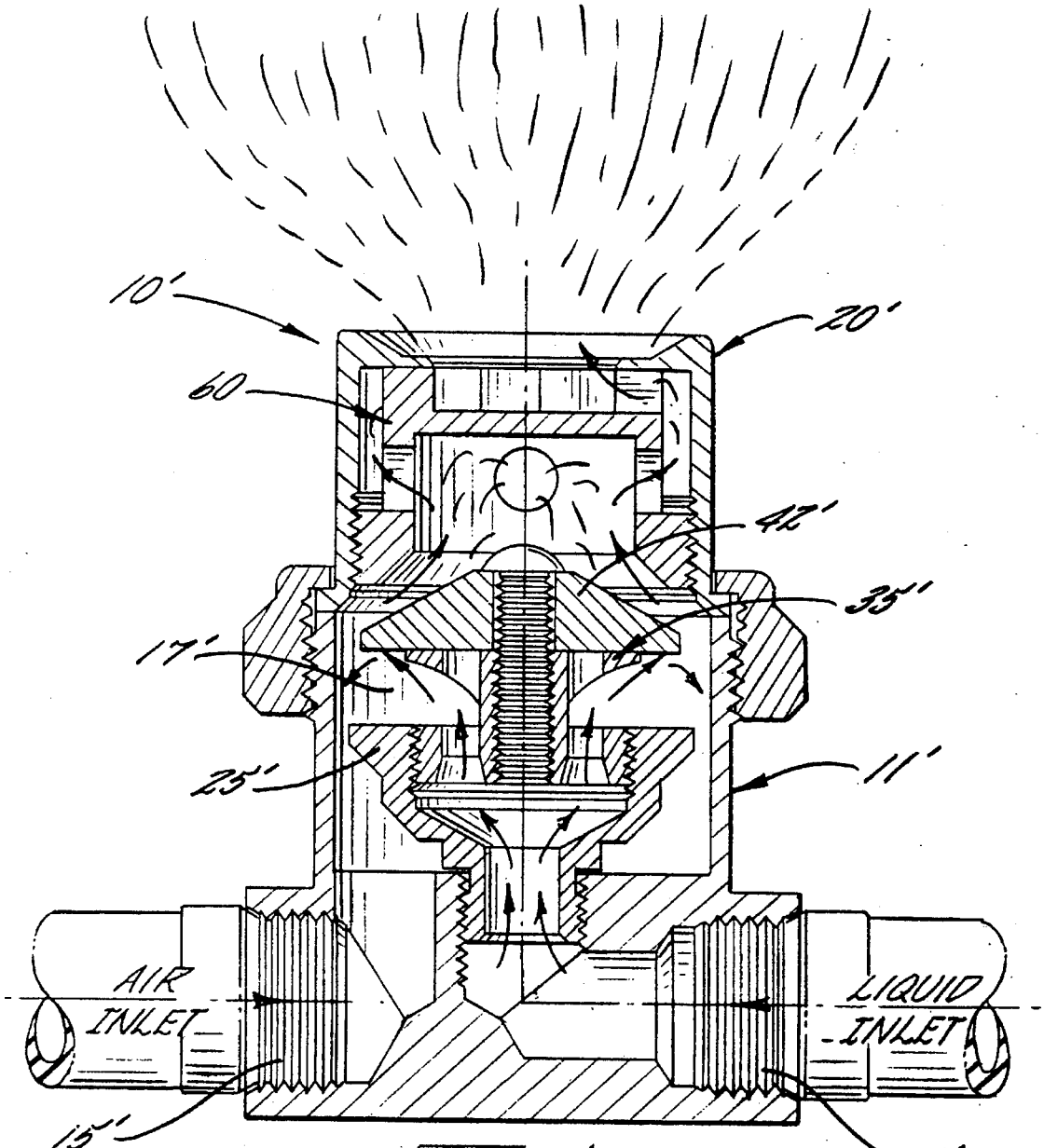

Modified apparatus 10' is shown in FIG. 4 in which parts corresponding to those of the first embodiment are indicated by the same but primed reference numerals In the apparatus 10', the ports 14' and 15' are formed in opposite sides of the body 11' rather than in an end thereof. In addition, provision is made of a modified nozzle 20' of a type disclosed in my U.S. application Ser. No. 08/371087, filed Jan. 10, 1995 and entitled Enhanced Efficiency Atomizing and Spray Nozzle. The modified nozzle includes a cap 60 which imparts turbulence to the liquid and effects substantial additional atomization prior to the liquid being discharged from the nozzle. Reference may be made to the aforementioned application for a detailed disclosure of the nozzle 20' with the atomizing cap 60.

I claim:

1. Apparatus for atomizing liquid and for discharging a finely atomized liquid spray, said apparatus comprising a body having a liquid inlet for a stream of pressurized liquid and a gas inlet for a stream of pressurized gas, said body having an annular wall defining a chamber with upstream and downstream ends, a spray nozzle having a discharge orifice communicating with the downstream end of said chamber, a member fixed within said chamber and being formed with a plurality of circumferentially spaced orifices for dividing said liquid stream into a plurality of circumferentially spaced liquid jets which are discharged out of said member and substantially axially into said chamber, a deflector fixed in said chamber downstream of said member, said deflector being formed with a plurality of holes in alignment with said orifices with the downstream ends of said holes being closed whereby the liquid jets emerging from said orifices enter said holes, impinge against closed ends thereof, and bounce back toward said member, said deflector having a surface for forming the liquid between said member and said deflector into a turbulent sheet and for guiding said sheet outwardly toward said wall, means located in said chamber and having a peripheral edge disposed downstream of said deflector surface and spaced radially inwardly from said wall whereby the sheet of liquid leaving the deflector surface impinges against said edge and is further broken into fine droplets, said chamber communicating with said gas inlet, and means in said chamber for forming said gas stream into a high velocity annular curtain which impacts against and further atomizes said liquid as said liquid flows between said edge and said wall.

2. Apparatus as defined in claim 1 in which said means having said peripheral edge comprises a plate located downstream of said deflector, said plate closing the downstream ends of said holes.

3. Apparatus as defined in claim 1 in which said member and said deflector are an integral component.

4. Apparatus as defined in claim 1 in which said member and said deflector are an integral component, there being an annular and radially outwardly opening slot between said member and said deflector, said slot having a downstream surface defined by said deflector surface.

5. Apparatus for atomizing liquid and for discharging a finely atomized liquid spray, said apparatus comprising a body having a liquid inlet for a stream of pressurized liquid and a gas inlet for a stream of pressurized gas, said body having an annular wall defining a chamber with upstream and downstream ends, a member fixed within said chamber for defining a plurality of liquid flow passages for dividing said liquid stream into a plurality of liquid jets which discharge past said member and substantially axially into said chamber, a deflector fixed in said chamber downstream of said member and having a discontinuous surface against which said axially directed liquid jets impinge and bounce back upstream toward said member, said deflector having a guide surface radially outwardly of said discontinuous surface for forming the liquid between said member and said deflector into a turbulent sheet of liquid and for guiding said sheet outwardly toward said wall, said body defining an annular gas passage communicating between said gas inlet and said chamber for forming said gas stream into a high velocity annular curtain which impacts against the turbulent sheet of liquid as said liquid flows outwardly from said deflector toward said wall for further breaking down and atomizing said liquid, and a discharge nozzle connected to said body downstream of said deflector for directing said further atomized liquid into a predetermined discharge spray pattern.

6. Apparatus as defined in claim 5 in which said discontinuous surface is formed with a plurality of holes in axial alignment with said plurality of liquid flow passages.

7. Apparatus as defined in claim 5 in which said member and said deflector are an integral component.

8. Apparatus as defined in claim 6 including a plate mounted downstream of said deflector, said plate having a peripheral edge which together with said wall defines an annular passageway through which said further atomized liquid is directed.

9. Apparatus as defined in claim 8 in which said member downstream of said deflector is a plate which closes the downstream ends of the holes in said deflector.

* * * * *